United States Patent [19]

Gregory

[11] 4,341,286

[45] Jul. 27, 1982

[54] FIRE ESCAPE IMPROVEMENT

[76] Inventor: Charles A. Gregory, Ormsbee Rd., Porters Corners, N.Y. 12859

[21] Appl. No.: 206,264

[22] Filed: Nov. 12, 1980

[51] Int. Cl.[3] ..... A62B 1/06; A62B 1/20

[52] U.S. Cl. ..... 182/10; 182/3; 182/48; 182/100; 182/189

[58] Field of Search ..... 182/10, 11, 48, 49, 182/100, 84, 86, 189, 3

[56] References Cited

U.S. PATENT DOCUMENTS

| | | | |
|---|---|---|---|
| 89,686 | 5/1869 | Richardson | 182/10 |
| 336,414 | 2/1886 | Kerr | 182/10 |
| 390,446 | 10/1888 | Bruce | 182/10 |
| 952,315 | 3/1910 | Erwin et al. | 182/48 |
| 1,282,323 | 10/1918 | Trinkle | 182/10 |
| 2,965,193 | 12/1960 | Murphy | 182/100 |
| 3,880,254 | 4/1975 | Fitzgerald | 182/10 |
| 3,921,757 | 11/1975 | Kennedy | 182/48 |

*Primary Examiner*—Reinaldo P. Machado

[57] ABSTRACT

An improved, self-storing, telescoping fire pole which can be thrust manually, mechanically, or electrically out and away from a building at an angle, to an actuated position to provide a slide pole from a building to the ground; and when actuated into its functioning position, also can provide a safe and effective slide-support chute for carrying children, the physically handicapped, or elderly people to ground level.

4 Claims, 5 Drawing Figures

2
4
6
7
8
10
12
14
16
18
20
21
26

Fig. 4
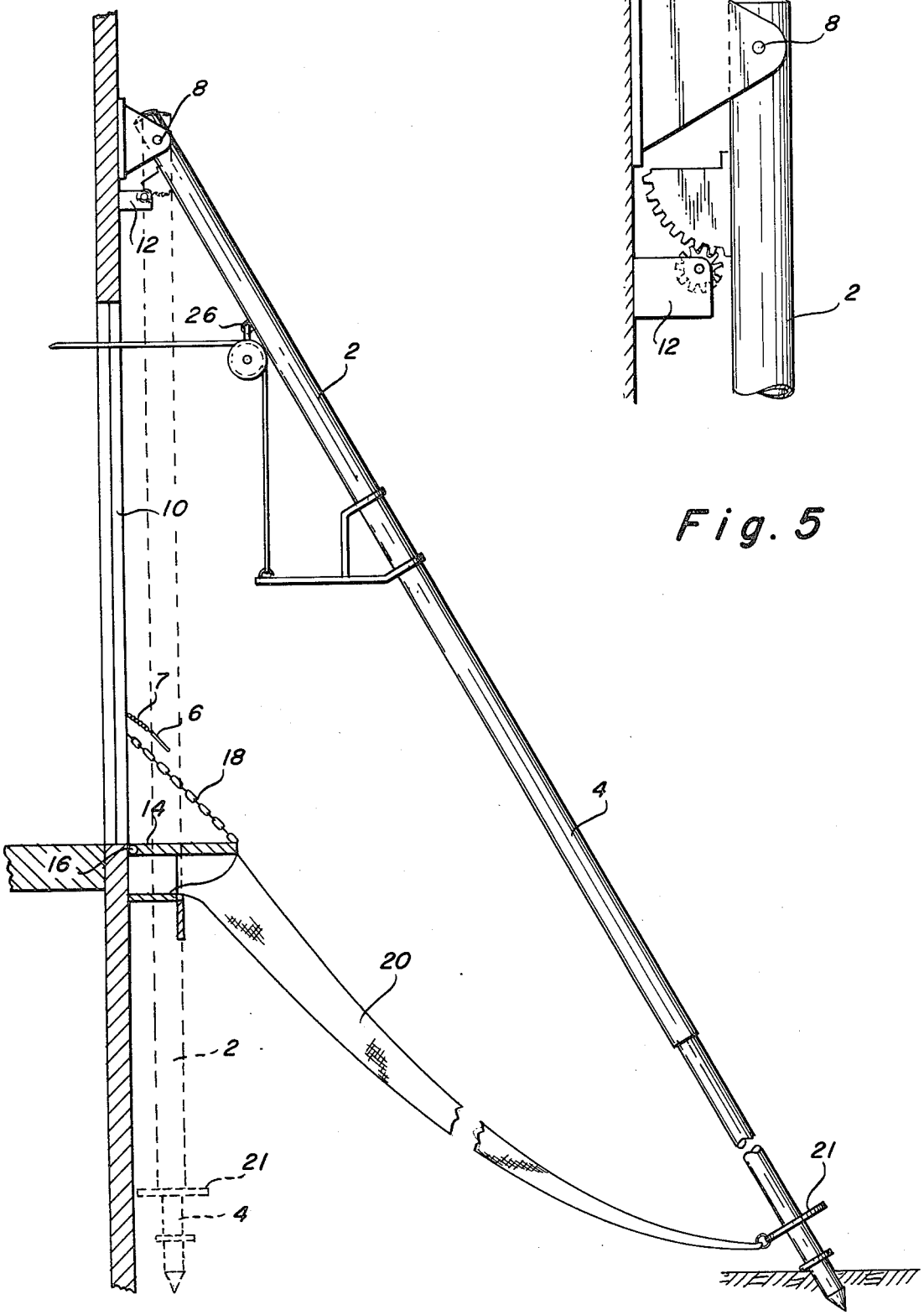
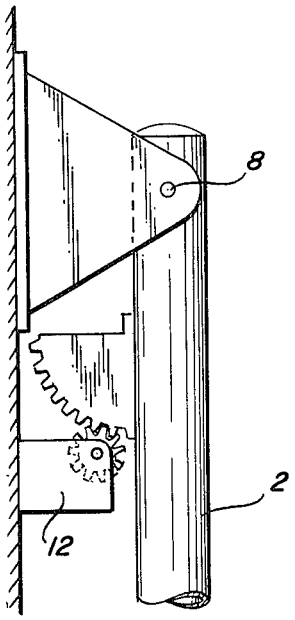
Fig. 5

FIRE ESCAPE IMPROVEMENT

BACKGROUND OF THE INVENTION

The present invention relates to an improved fire escape, and particularly a normally stored fire escape that can be actuated to its functioning position with simple force application.

For years people have known the need for fire escape techniques and the idea of the fire pole in a fire house has been known to all of us since childhood. The fact that it still exists in modern fire houses establishes and evidences its worth.

We're all familiar with the typical fire escape in apartment houses wherein heavy iron structures are secured to the outside walls of a building to permit people to descent from one level to the other along iron stairs to a first level. Then, at the first level, a balanced stair is mounted to be inaccessible to one who is at the ground level, while permitting a person to descend from the first level to ground level.

It's obvious that the typical fire escape described above is considered a functionally sufficient device since there are so many of them located in the cities of the world.

It must be admitted, however, that these iron fire escapes are both expensive and unattractive, accordingly.

It is the first objective of this invention to provide an improved self-storing fire escape.

It is a further objective of this invention to provide a self-storing fire escape that can be actuated either manually, mechanically, or electrically, from its stored position into a functioning position.

It is a further objective of this invention to provide a self-storing fire escape that is mounted for actuation into a functioning position and which actuation provides the force to move a slide-support chute into position to carry children or the physically handicapped, or elderly people, to ground level.

It is a still further objective of this invention to provide a self-storing fire escape device which when actuated to a functioning position is equipped with ancillary supports for a hoist system, to permit children and incapacitated people to be lowered, breeches-buoy fashion, to ground level.

DESCRIPTION OF THE DRAWINGS

These and other objects and advantages of this invention will become apparent with reference to the following specifications and drawings, wherein:

FIG. 4 is an enlarged side elevation of the device in use position, with the stored position shown in dashed lines; and FIG. 5 is an enlarged fragmentary view of the drive pinion and rack assembly.

DETAILED DESCRIPTION OF THE INVENTION

Figures 1, 2, 3:
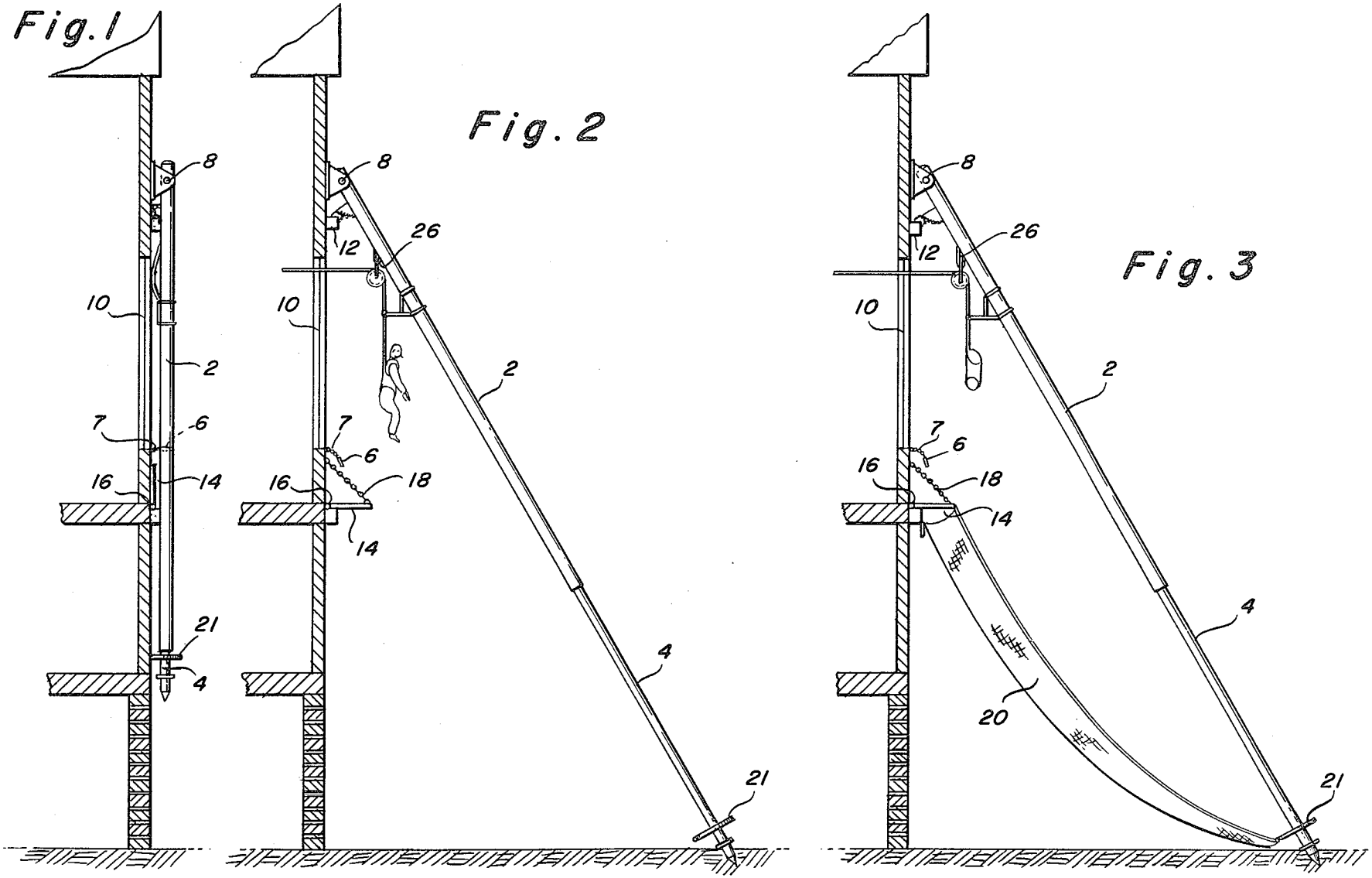
FIG. 1 is a side elevation view partially in section of the self-storing fire escape device.
FIG. 2 shows the self-storing fire escape device actuated to its functioning position.
FIG. 3 shows the self-storing fire escape device actuated to the functioning position and carrying an ancillary chute for sliding people to the ground level.

The basic elements of this invention are a pipe 2, which encloses a telescopic section 4, axially slideable within and normally positioned within and encompassed by pipe 2, a transverse pin 6, which normally holds the telescopic portion housed within the pipe 2, (it should be noted that while the proposed embodiment shows a single telescopic section 4, additional sections could be telescoped within the section 4, to provide a greater, extended length) and a support for one end of pipe 2.

The pipe 2, in a preferred embodiment, is a 2" seamless galvanized pipe which has one end secured to the building by a pivot 8, at such a location that when the telescopic section 4, is extended and the pipe 2, is rotated at an angle of approximately 30° from the building, the telescopic section will reach the ground to provide a slide pole. The pipe 2, normally hangs by gravity alongside the building in the retracted or housed position. The pin 6, holds the telescopic portion 4, from sliding out of the pipe. 2.

It is to be noted that pin 6, is secured by a chain 7, to the building whereupon the pin 6, is pulled out of pipe 2, as the latter is pivoted away from the building, thereby releasing the telescopic section 4.

OPERATION

With the pipe 2, normally in its vertical or stored position, the slide escape is actuated by pivoting the pipe 2, out and away from the building to approximately a 30° degree angle, thereby releasing the pin and permitting the central telescopic section to slide into the ground. The pole, or pipe 2, can be rotated outwardly by any one of a number of techniques. For example, if the window 10, is ajar, a person could reach out to the pole and push it to pivot it out, away from the house.

In a mechanical embodiment, however, a motor 12, is located below the hinge point and is geared or otherwise connected to the pipe 2, to pivot it out to a selected angle before the telescopic section of the pipe is released to plunge into the ground. This motor obviously could be controlled by a push-button or by a conventional heat-sensitive device (neither of which is shown).

Acting in conjunction with the pipe 2, is platform 14, positioned beneath a window or door opening and hingedly secured to the house by a conventional hinge 16. With this structure, when the pipe 2, is pushed away from the house, the platform 14, will rotate under the influence of gravity through 90° to a horizontal position where it will be supported both by the hinge 16, and by chains 18.

Once the pipe 2, is in its functioning position, and the platform 14, is in its horizontal position, a person can step out of the window onto the platform 14, and simply grip the pipe 2, and slide down it to the ground, to safety, just as a fireman slides down a fire pole.

This invention, however, has a further improvement which provides still greater safety for children, the physically handicapped, and elderly people. In particular, as shown in FIG. 3 of the drawing, a waterproof, rip-proof, fireproof canvas chute 20, is rolled and housed in a pocket directly under the platform 14. The chute is rolled in such a manner that one end of it is connected to the outer lip of the platform 14, while the other end carries a ring 21, which encircles the pole 2. Ring 21 is connected to the outer extremity of telescopic portion 4. This connection provides the force to extend chute 20, to its active position—as the telescopic portion 4, is moved to its active position. When the pole is pivoted out, the ring 21, which encircles the pole 2, will slide down or can be pulled down to the position where it engages the lower tip of the extension 4, then with the upper part of the chute connected to the outside of the platform 14, a slide chute is provided for the safe slide-decent of children, the physically handicapped, or the elderly from the platform surface to the ground.

In a still further embodiment of this invention, a hook 26, is located on the pole 2, to provide a fixed support for a block and tackle. A moveable support slides along poles 2 and 4, whereby a person can be placed out the window onto the platform and then hooked to a block and tackle by which he can be lowered to the ground in breeches buoy fashion.

It has been found in practice that this simple two-piece pole fire escape is very practical and operates to provide ready escape from a building. The addition of the chute and the tackle connection give added value to this extremely useful device.

It is obvious that the present embodiment of the invention is to be considered as only illustrative and not restricted since the invention spirit or essential characteristics of it.

Accordingly, what is claimed and desired to be secured by United States Letters Patent, is:

1. An improved Fire Escape Device comprising:

a multi-section axially telescopic pole;

a transverse pin positioned normally in said pole to hold said telescopic piece in housed position, pivot means attaching said pole at its upper end to a building thereby supporting said pole to lie normally alongside said building, while permitting said pole to be pivoted outwardly from said building, means restricting said transverse pin to pull the same from said pole as the latter is pivoted away from the building, thereby releasing the stored telescopic sections for gravity actuation to a slide pole position.

2. The structure of claim 1, in combination with a platform, means mounting said platform outside said building for pivotal movement from a vertical or stored position to a horizontal or actuated position in response to the pivoting of said pole to its actuated position.

3. The structure of claim 2, in combination with a chute, means storing said chute normally in an inactive position with one end connected to the outer edge of said platform and the other being connected to the lower sections of said telescopic sections, whereby said chute is pulled into a slide position as said platform drops into place and as said telescopic section falls to its actuated position.

4. The structure of claim 2 in combination with a breeches buoy and means supporting the same on said slide pole to provide transport from one level to another.

* * * * *